US008009004B2

(12) United States Patent
Ahangar et al.

(10) Patent No.: US 8,009,004 B2
(45) Date of Patent: Aug. 30, 2011

(54) ELECTRIC COIL AND CORE COOLING METHOD AND APPARATUS

(75) Inventors: Abdolmehdi Kaveh Ahangar, Brown Deer, WI (US); Jeremy J. Keegan, Kewaskum, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 13/030,255

(22) Filed: Feb. 18, 2011

(65) Prior Publication Data

US 2011/0140822 A1 Jun. 16, 2011

Related U.S. Application Data

(63) Continuation of application No. 11/823,394, filed on Jun. 27, 2007, now Pat. No. 7,893,804.

(51) Int. Cl.
*H01F 27/08* (2006.01)

(52) U.S. Cl. ..... 336/60

(58) Field of Classification Search ..... 336/55–62, 336/220–223; 361/676, 699
See application file for complete search history.

(56) References Cited

U.S. PATENT DOCUMENTS

| | | | | |
|---|---|---|---|---|
| 4,956,626 | A | 9/1990 | Hoppe et al. | |
| 6,940,203 | B2 | 9/2005 | Kogan et al. | |
| 7,129,808 | B2 * | 10/2006 | Roebke et al. | 336/55 |
| 7,212,406 | B2 * | 5/2007 | Kaishian et al. | 361/699 |
| 7,227,754 | B2 | 6/2007 | Griesinger et al. | |
| 2008/0174393 | A1 | 7/2008 | Schnetzka et al. | |

* cited by examiner

*Primary Examiner* — Tuyen Nguyen
(74) *Attorney, Agent, or Firm* — Fletcher Yoder LLP; Alexander R. Kuszewski; John M. Miller

(57) ABSTRACT

Provided is an electrical apparatus comprising a magnetic core, a conductive coil wound around at least a part of the core, a cooling element configured to receive a cooling fluid to cool the core and the coil during operation, and at least one biasing element operatively associated with the core to urge the core and the coil into engagement with the cooling element despite differential expansion or contraction of the core and the coil and manufacturing tolerances. Further provided is a method for making an electrical apparatus comprising disposing a conductive coil wound around at least a part of a magnetic core, disposing a cooling element between the core and the coil, the cooling element configured to receive a cooling fluid to cool the core and the coil during operation, and urging the core and the coil into engagement with the cooling element despite differential expansion or contraction of the core and the coil and manufacturing tolerances.

20 Claims, 6 Drawing Sheets

ELECTRIC COIL AND CORE COOLING METHOD AND APPARATUS

CROSS REFERENCE TO RELATED APPLICATIONS

This application is a continuation of application Ser. No. 11/823,394, filed Jun. 27, 2007, entitled "Electronic Coil and Core Cooling Method and Apparatus" in the name of Abdolmehdi Kaveh Ahangar et al.

BRIEF DESCRIPTION

The present invention relates generally to the field of power electronic devices and their thermal management. More particularly, the invention relates to a technique for improving cooling and heat distribution in power modules.

Power electronic devices and modules are used in a wide range of applications. For example, in electric motor controllers, rectifiers, inverters, and more generally, power converters are employed to condition incoming power and supply power to devices, such as a drive motor. However, the power and signals transmitted within the electronic devices often contain undesirable characteristics that may require additional devices to reduce or filter the signals. For instance, in alternating current (AC) motor controllers, a rectifier may be used to covert the AC power to stable direct current (DC) power, and an inverter may be used to convert the stable DC power back to the AC power supplied to the motor.

In a standard three phase rectifier (e.g., input converter) that uses six silicon-controlled rectifiers (SCR's) or six diodes and a filter capacitor bank, the three phase input current may contain harmonic distortions. Often, an inductor, such as a reactor or choke, may be added to the system to reduce the harmonics. For example, a reactor may be included at the input of the circuit to reduce the harmonics. Similarly, a choke may be added to buffer the capacitor bank from the AC line to reduce the harmonics. Accordingly, inductors may be useful in circuits for motor drives and other applications where characteristics of inductors are beneficial to the system. However, the design of such inductors may include inherent limitations, including the potential to build up heat within the inductor.

An inductor usually includes a passive electronic device constructed of a conductive coil of material (e.g., wire or foil) wrapped around a core of air or a ferromagnetic material (magnetic core). Passing electrical current through the conductive coil generates a magnetic flux proportional to the current. The inherent resistance of this winding converts electrical current flowing through the conductive coils into heat due to resistive losses, causing a loss of inductive quality. This may be referred to as coil loss. Further, energy loss that occurs in inductors may include core losses. Core losses may be attributed to a variety of mechanism related to the fluctuating magnetic field, such as eddy loss currents and hysteresis. Most of the energy is released as heat, although some may be mechanical, potentially resulting in audible signals ("hum"). The build up of heat due to coil losses and core losses may reduce performance of the inductor, and lead to failure of the device. Similar problems may be experienced by similarly constructed devices.

Accordingly, there is a need for improved techniques and cooling systems for removing heat from electronic modules and power converters.

BRIEF DESCRIPTION

The invention provides a novel approach to power electronic device thermal management. The technique may be applied in a wide range of settings, but is particularly well-suited to inductors, and similar devices. The technique may be utilized with single coil or multiple coil inductors, such as those used in single phase alternating current power systems, three-phase alternating current systems, or direct current power systems. A presently contemplated implementation, for example, is with a reactor used in a three-phase alternating current power system.

The technique relies upon a biasing element adjacent to a magnetic core of an inductor. The element may be provided between multiple core elements or pieces. The biasing element provides a biasing force to urge at least one cooling element disposed within the inductor into contact with a coil, and, where desired, into good thermal contact with both the core and the coil. The contact may close this and reduce the thermal resistance at the interfaces of the components, and thus promote heat transfer from the magnetic core and the conductive coil to the cooling element. The cooling element is configured to extract the heat from the inductor, such as via the flow of a cooling fluid.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Various electronic circuits benefit from the use of inductors. Although inductors are useful for filtering, smoothing or otherwise conditioning power signals, inductors, including reactors, chokes, transformers, and the like, generally produce heat due to core and coil losses. Heat may degrade the performance of the inductor, or may cause degradation and premature failure of the device. Accordingly, the following embodiments provide a system and method to remove thermal energy from the core and the coils of an inductor. In certain embodiments, a cooling element is disposed adjacent to a core, such as between the core and the coil of an inductor such that it may absorb the heat generated by the inductor. In a presently contemplated embodiment, the core includes multiple core pieces that are urged outward by a biasing element disposed between the core pieces. Urging the core pieces outward promotes contact between the core pieces and a cooling element located proximate to the core. Contact between the surface of the core and the surface of the cooling element may reduce the thermal resistance across the interface to promote heat transfer between the core and the cooling element. Accordingly, the effectiveness of the cooling element may be improved. Similarly, the biasing element may also urge the cooling element into contact with surfaces of the conductive coil. This improved contact may reduce the thermal resistance between the conductive coil and the cooling element, and increase the effectiveness of the cooling element to remove heat from the conductive coil. The system and technique are generally applicable to similarly constructed systems that may benefit from improved surface contact between components.

Figure 1:
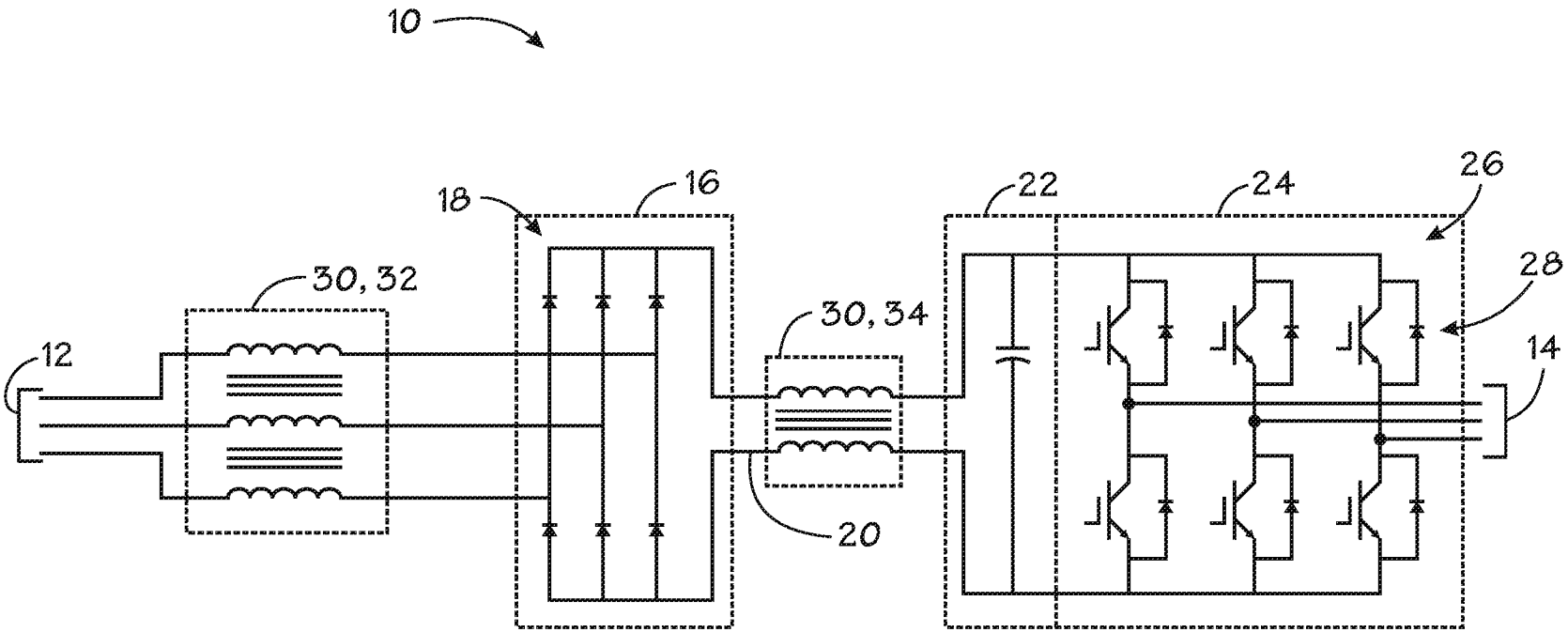
FIG. 1 is a diagrammatical overview of an exemplary power electronic circuit implementing inductors, including a three-phase reactor and a choke, in accordance with aspects of the invention.

FIG. 1 illustrates an exemplary embodiment of a power circuit 10 including two inductors. In the illustrated embodiment of FIG. 1, the power circuit 10 may be provided as part of a power module, such as for a motor drive. The power circuit 10 is adapted to receive three-phase power from a line side 12 and to convert the input power to an output power delivered at a load side 14. It should be noted that this particular circuit of FIG. 1 is merely one example of an environment that this invention may be usefully employed.

In the embodiment illustrated in FIG. 1, the power circuit 10 includes a rectifier 16 defined by an array of six diodes 18, although SCRs or other power electronic devices may be used in place of diodes. The diode array converts three-phase AC input power to DC power that is applied to a DC bus 20. The power circuit 10 also includes a capacitive filter 22 formed from a capacitor bank. The capacitive filter may be desired to smooth ripple current on the DC bus, for instance. Further, an inverter 24 is formed by an array of switches 26 and associated fly-back diodes 28. The inverter may include high-speed transistors as switches to apply a pulse width modulated (PWM) waveform to the load side 14 to power a motor, for instance.

Standard motor drives that are configured to draw from the power circuit 10 may include "six pulse" drives that have a non-linear load. These drives tend to draw current only periodically during positives and negatives during loses of input power. Because the current wave-form is not perfectly sinusoidal the current may contain undesired harmonics. For instance, with a standard three-phase rectifier using six diodes 18, or SCRs, and a capacitive filter 22, as depicted in FIG. 1, the three-phase input current may contain an increased amount of harmonic distortion. The harmonic distortion may be reduced with the addition of inductors, such as reactors and chokes, to the power circuit 10.

A reactor may be added at the line side 12 or DC bus of a power circuit 10 to reduce harmonics. This reactor or inductor reduces the rate of change of current. It may force the capacitive filter 22 to charge at a slower rate drawing current over a longer period of time. In one embodiment of the power circuit 10, an inductor 30, may be configured as an input reactor 32 to reduce the harmonics. As illustrated in FIG. 1, the reactor 32 is located between the line side 12 and the rectifier 16. In this embodiment, the reactor 32 includes three coils, wherein each coil is configured to receive power from one conductor of the three phase conductors of the line side 12, and to transmit the power to a respective phase input of the rectifier 16. In this configuration, the reactor 32 may reduce harmonics and limit the peak current into the rectifier 16 and the capacitive filter 22.

In other configurations (not shown), the power circuit 10 may include a reactor 32 located between the inverter 24 and the load side 14. In such a configuration, the reactor 32 may buffer the current at the load side 14, such as the current input to a motor drive.

The illustrated embodiment of the power circuit 10 also includes a DC choke 34. The choke 34 is located on the DC bus 20, between the rectifier 16 and the capacitive filter 22. The choke 34 may help to buffer the capacitive filter 22 from the AC line and to reduce harmonics. The choke 34 may protect the power circuit 10 against a current surge. However, the choke 34 may not protect the rectifier 16 from a voltage spike, as the choke 34 is located downstream of the rectifier 16.

Embodiments of the power circuit 10 may include a single inductor, such as the reactor 32 at the line side 12, the load side 14, or the choke 32. Other embodiments may include various combinations of the three, as depicted in FIG. 1.

As mentioned previously, the reactor 32 and the choke 34 are both forms of inductors. Accordingly, the characteristics of such inductors may be critical to the operation in which they are installed, such as power circuit 10. Such inductors generally include a passive electrical device that is employed in an electrical circuit for its property of inductance. Inductance (measured in Henries) is an effect which results from the magnetic field that forms around a current carrying conductor. An inductor typically consists of a coil of conducting material (e.g., conductive coil or wire or foil) wrapped around a core. The core typically comprises air or a ferromagnetic material (magnetic core). Electrical current passed through the conductive coil creates a magnetic flux field proportional to the current. A magnetic core is a key component of higher power inductors, as the magnetic core increases the strength and effect of the magnetic field produced by the electric current passed through the conductive coil.

Configurations and the design of inductors may vary based on specific applications. For example, inductors may include a single conductive coil disposed about a singe magnetic core. In other embodiments, inductors may include multiple conductive coils, each wound about a portion of the magnetic core. For example, the reactor 32 may include a total of three conductive coils (one for each conductor of three-phase power from the line side 12) wrapped about a magnetic core. Other inductors may include two or more conductive windings about a magnetic core, wherein the conductive coils are magnetically coupled to form a transformer.

The inherent resistance of inductor coils converts a portion of electrical current flowing through the conductive coils into thermal energy (heat), causing a loss of inductive quality. This may be referred to as coil loss. Further, an inductor may experience energy loss attributed to a variety of mechanisms related to the fluctuating magnetic field, such as eddy loss currents and hysteresis. This form of energy loss may be referred to as core losses. Most of the energy due to coil losses and core losses is released as heat. Accordingly, heat may build up within the inductor if it is not dissipated or removed. Unfortunately, the build up of heat within the inductor may reduce performance of the inductor, and/or lead to failure of the device.

Figure 2:
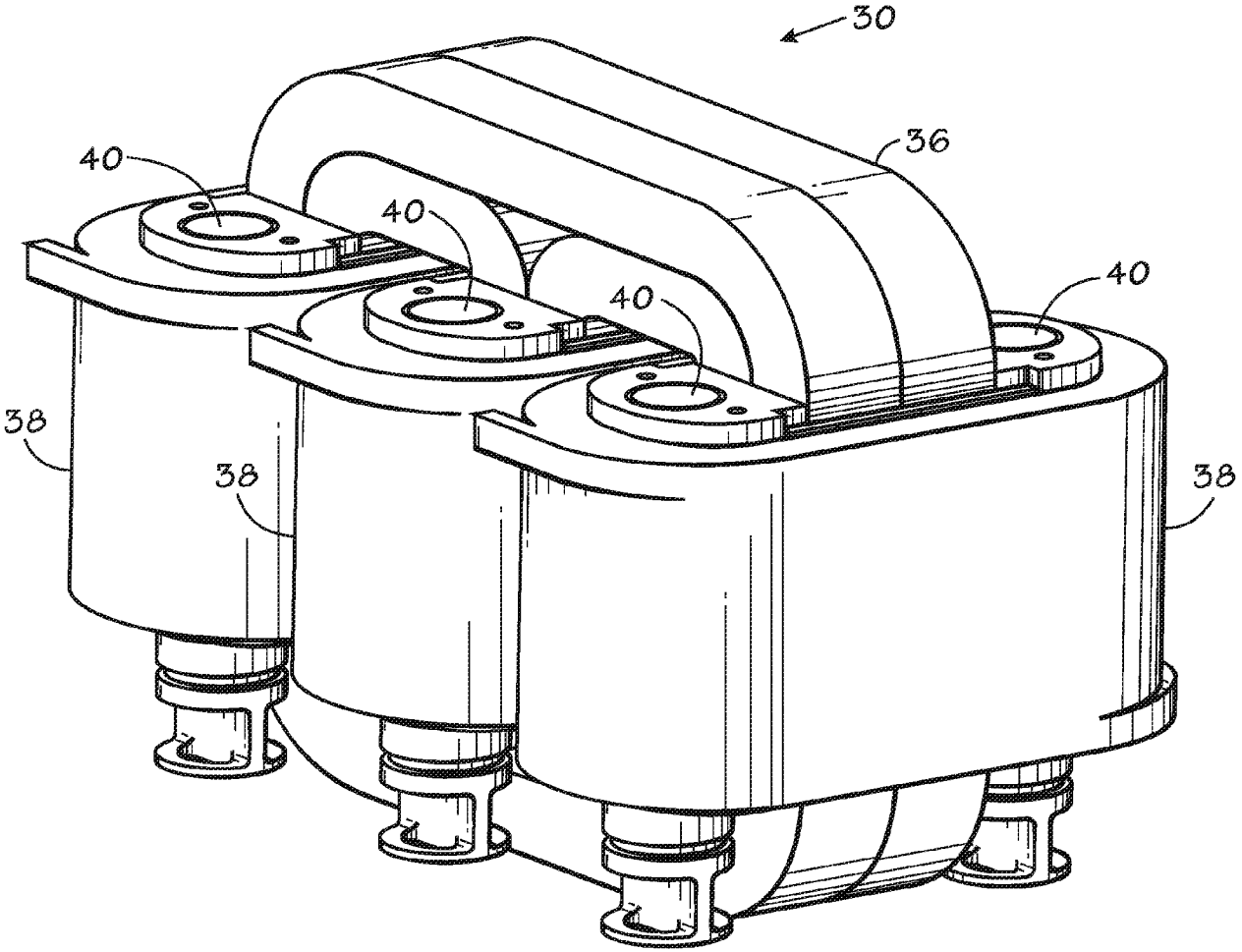
FIG. 2 is an illustration of an exemplary embodiment of the three-phase reactor of FIG. 1.

Turning now to FIG. 2, an inductor 30 in accordance with an embodiment of the present technique is illustrated. The inductor 30 has a magnetic core 36, conductive coils 38, and cooling elements 40. More particularly, the inductor 30 includes the magnetic core 36 surrounded by three conductive coils 38, with two cooling elements 40 disposed between each conductive coil 38 and the magnetic core 36, resulting in a total of six cooling elements 40 for the particular embodiment illustrated.

Figure 3:
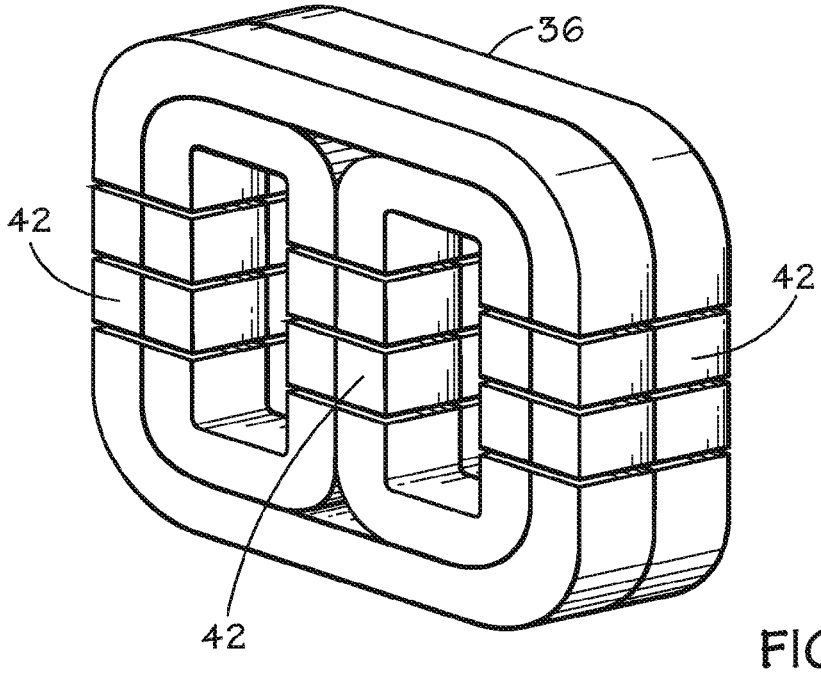
FIG. 3 is an illustration of an assembled magnetic core piece of the reactor of FIG. 2.

The overall design of the inductor 30 may be varied to meet specific applications and the desired performance. For example, as illustrated in FIGS. 2 and 3, the magnetic core 36 includes a "figure-eight" shaped geometry. In this configuration, each leg 42 of the magnetic core 36 may be surrounded by a conductive coil 38 to form the inductor 30. However, the geometry of the magnetic core 38 may be varied depending on the application. For example, other embodiments of the magnetic core 36 may have "I", "C," "E," toroidal, planar, or pot shaped geometries, and so forth. The magnetic core 36 may also include a geometry formed from a combination of shapes. For example, the figure-eight shape of FIG. 2 may include an "I" shaped piece and an "E" shaped piece, or two "E" shaped pieces, combined to for the single magnetic core 36.

The magnetic core 36 may comprise various materials suitable for use in an inductor 30. In one embodiment, the magnetic core 36 may be formed from copper, aluminum, or steel. For instance, the magnetic core 36 may include conductive "tape" wrapped to form the body of the magnetic core 36. Other embodiments may include various materials as well as other techniques to form the core. For instance, iron may be used as to form a unitary magnetic core 36. The magnetic core 36 may also include iron alloyed with silicon, for example. Other materials used to form the magnetic core 36 may include carbonyl iron, ferrite ceramics, and so forth.

Further, various forming techniques, such as lamination and the like, may be employed to form the magnetic core 36. Laminating multiple pieces to form the magnetic core 26 may aid in the reduction of undesired eddy currents.

Figure 4:
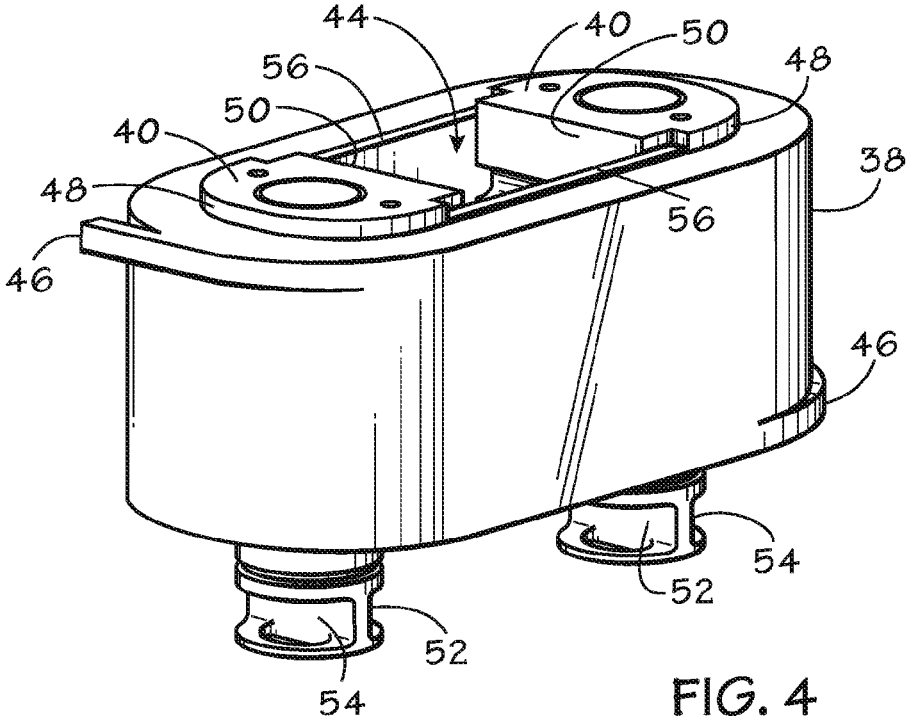
FIG. 4 is an illustration of assembled components of the reactor of FIG. 2.
Figure 5:
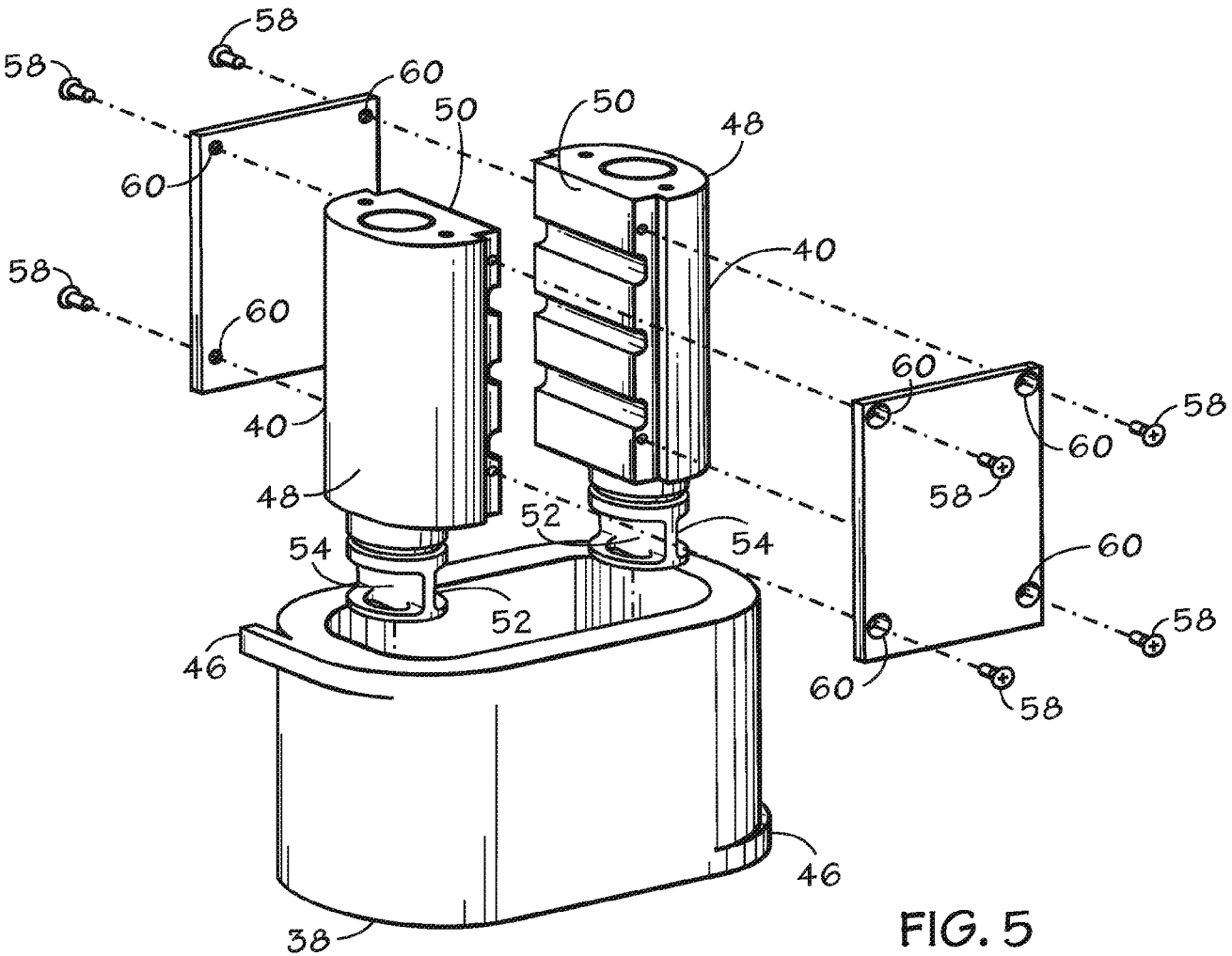
FIG. 5 is an illustration of an exploded view of the a conductive coil, cooling element and support of the reactor of FIG. 4.

FIG. 4 is an illustration of an assembled conductive coil 38 and cooling element 40. This is representative of one of the three conductive coils 38 and one of the three pairs of cooling elements 40 depicted in FIG. 2. Similarly, FIG. 5 is an illustration of the assembly of FIG. 4, exploded to provide an improved view of the conductive coil 38 and the cooling elements 40.

The conductive coil 38 includes various features that may be desired for use within in the inductor 30. In one embodiment, the conductive coil 38 includes a coil of material disposed about a central region 44. As depicted, the central region 44 includes an opening configured to accommodate at least a portion of the magnetic core 36. Further, the central region 44 provides a location to dispose the cooling elements 40. For example, cooling element 40 may be disposed at both ends of the conductive coil 38, as depicted.

The conductive coil 38 also includes leads 46 configured to connect to other conductors, such as one of the three conductors at the line side 12, and one of the three conductors output to the rectifier 16, as depicted in FIG. 1. The leads 46 provide for the flow of current through the conductive coil 38. Accordingly, the inductor 30, as depicted in FIG. 2, may include a total of six leads 46 (two at each of three conductive coils 38). Each lead is configured for connection to an input or an output of the three conductors in a three-phase power system. The conductive coil 38 may include any number of coil turns or wraps around the central region, as desired by a specific application.

The conductive coil 38 may be composed of various materials. In one embodiment, the conductive coil 38 may include copper, aluminum or steel windings. In other embodiments, the conductive coil 38 may comprise other conductive materials suitable for use in the inductor 30.

The cooling element 40, as depicted in FIGS. 2, 4, and 5, may take a variety of shapes and configurations to provide for the removal of heat from components of the inductor 30, including the magnetic core 36 and the conductive coil 38. For instance, each of the depicted cooling elements 40 has a semicircular shape, including a curved surface 48 and a generally flat surface 50. In a presently contemplated embodiment, a surface, such as the curved surface 48, may have a shape configured to conform to a curvature at an end turn of the conductive coil 38. For example, the cooling elements 40 may be disposed within a conductive coil 38 that has been formed prior to placement of the cooling elements 40. In another embodiment, the conductive coil 38 may conform to the shape of the cooling element 40. For instance, forming the conductive coil 38 may include fixing the cooling elements 40 in a position and subsequently wrapping the windings of the conductive coil 38 about the cooling elements 40. The generally shared profile at each end turn may promote contact of the conductive coil 38 and the cooling element 40 such that thermal energy may be more efficiently transferred between the conductive coil 38 and the cooling element 40. For example, disposing the conductive coil 38 and the cooling element 40 such that they are proximate to one another along the curved surface 48 may reduce thermal resistance across that interface, and, thus, promote the transfer of thermal energy (heat) between the conductive coil 38 and the cooling element 40. Thus, heat from the conductive element 38 may be more efficiently removed by the cooling element 40.

Similarly, a surface of the cooling element 40 may be configured to contact other heat generating components, including the magnetic core 36. For instance, the flat surface 50 of the cooling element 40 is generally shaped to provide contact between the magnetic core 36 and the cooling element 40. Contact between the flat surface 50 of the cooling element 40 and a surface of the magnetic core 36 may enable a more efficient transfer of thermal energy (heat) between the magnetic core 36 and the cooling element 40. Thus, heat from the magnetic core may also be more efficiently removed by the cooling element 40.

Further, the cooling element 40 may include various features configured to provide for the transfer of heat from components of the inductor 30 to the cooling element 40. For instance, the cooling element 40 may comprise a thermally conductive material, such as aluminum. In certain embodiments, the body of the cooling element 40 may include various channels configured to circulate a cooling fluid through the cooling element 40. The circulation of a cooling fluid may help to remove heat from the cooling elements 40 and, thus, promote heat exchange between the cooling element 40 and components of the inductor 30. For example, the inductor 30 depicted in FIGS. 4 and 5 includes coolant inlets 52 and outlets 54 configured to receive coolant from an external source, such as a fluid pump (not shown.) In a diversely contemplated embodiment, coolant enters the cooling element 40 via the coolant inlet 52, passes through cooling channels internal to the cooling element 40, and exits from the cooling element 40 via the cooling outlet 54. The circulation of cooling fluid through the cooling element 40 provide for an increased rate transfer of thermal energy from other components of the inductor 30, such as the conductive coil 38 and the magnetic core 36.

The cooling fluid may include any gas or liquid capable of being passed through the cooling element 40 and including thermal properties beneficial to absorbing heat from the body of the cooling element 40. For example, the cooling fluid may include a water based liquid or an oil.

FIGS. 4 and 5 also depict a support 56 disposed between each of the cooling elements 40. The support 56 may be included to provide for spacing of the cooling elements 40. For example, the support 56 includes a plate of material fastened to each of the cooling elements 40 via fasteners 58 disposed through holes 60 in the support 56. This illustrates each set of cooling elements 40 includes two supports 56 that are fastened to the sides of the cooling elements 40. In this configuration, the conductive coil 38 may be wrapped around the cooling elements 40, with the supports 56 acting to maintain the open central region 44. Maintaining the central region 44 may provide a location to assemble the magnetic core 36 or other components of the inductor 30, for instance. The size, shape, and method of fastening the support 56 may be varied to accommodate applications.

In other embodiments, the support 56 may be a temporary component. For example, the support 56 may be included for assembly and placement of the cooling elements 40 and removed during assembly or prior to use of the inductor 30.

As mentioned previously, cooling of the inductor 30 may be provided via the cooling elements 40. The cooling elements 40 may be disposed proximate to the magnetic core 36 and/or the conductive coil 38 to remove thermal energy from the inductor 30. To promote the transfer of heat, the inductor 30 may include areas in which each cooling element 40 contacts the components to be cooled, such as the conductive coil 38 and the magnetic core 36. Good thermal contact between the surface of the cooling elements 40 and other components reduces thermal resistance across the interface to enable more efficient conduction of thermal energy between the components to the cooling element 40.

In design and assembly, components of the inductor 30 may generally include some surface contact with the cooling element 40. Even with good manufacturing tolerance, each of the components may experience expansion and contraction due to fluctuations in temperature during operation. The expansion of contraction in size may reduce or eliminate contact between components and the cooling element 40. This concern may become more prevalent due to use of different materials for each component and the differing coefficients of thermal expansion for each material.

Figure 6:
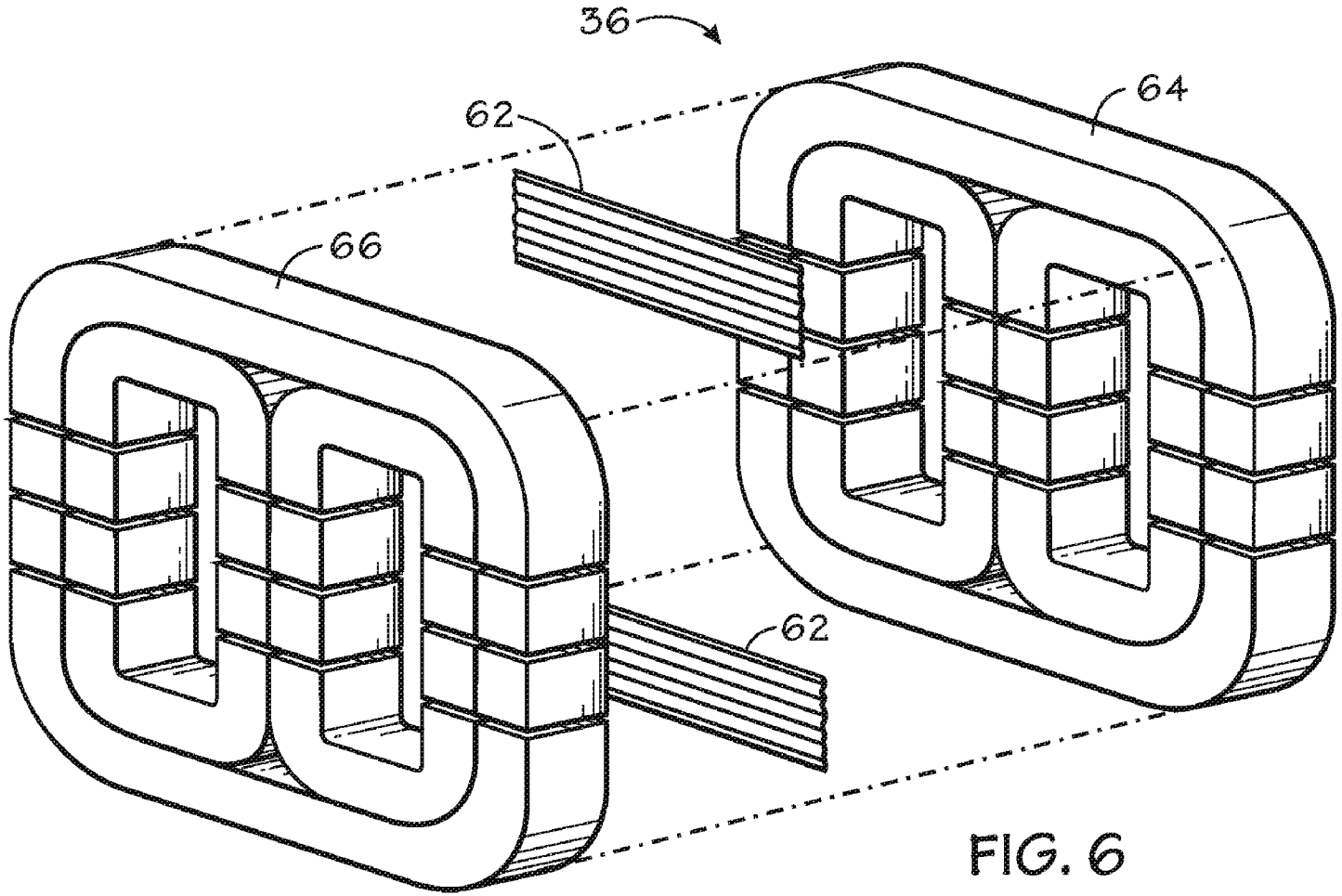
FIG. 6 is an illustration of an exploded view of the magnetic core and biasing element of the reactor of FIG. 2.

In the illustrated embodiment, the inductor 30 includes a magnetic core 36 and a biasing element 62 configured to urge the components of the inductor 30 into good thermal contact with the cooling element 40. As depicted in FIG. 6, the magnetic core 36 includes a first piece 64 and a second piece 66 with the biasing elements 62 disposed between the two pieces 64 and 66. The first piece 64 and second piece 66 may be configured to be positioned or mated together to form the magnetic core 36, as depicted in FIG. 1. The two pieces 64 and 66 may include two complementary pieces that are symmetrical or generally symmetrical, as depicted. In other embodiments, the first piece 64 and the second piece 66 may include any shape and design configured to accommodate a specific application. For example, the two core pieces 66 and 64 may be varied in thickness, or may include any of the core geometries described previously.

The biasing element 62 may include a component, mechanism or material capable of being disposed between the two pieces 64 and 66 of the magnetic core 36, and providing a biasing force to the pieces. The biasing element 62 exerts a force on the core pieces 64 and 66 after completion of assembly and closes any gap between the core 36, coil 38 and cooling element 40 due manufacturing tolerances. When the reactor is in operation and warms up, the biasing element 62 exerts a force between the core 36 and coil 38 and closes any gap that is developed between the core 36, cooling element 40 and core 36 due to thermal expansion mismatch between the components. This ensures improved thermal contact between the core 36, coil 38 and cooling element 40. As depicted, the biasing element 62 may include one or a plurality of corrugated sheets of material disposed at various locations between the faces of the two pieces 64 and 66 of the magnetic core 36. FIG. 6 illustrates two biasing elements 62 located symmetrically about the edges of the pieces 64 and 66 of the magnetic core 36. Other embodiment may include a single biasing element 62 or a plurality of biasing elements 62 disposed between the two pieces 64 and 66. In certain embodiments, the biasing element 62 may be pre-compressed during manufacturing. For example, the biasing element 62 may be compressed during assembly of the core 36 such that the biasing element 62 provides a constant reactive force against the pieces of the core 64 and 66.

Further embodiments may include alternate forms of the biasing element 62. For example, the biasing mechanism 62 may include a beveled washer, a linear spring, and the like. Other embodiments may include a mechanically flexible material that is configured to provide a reactive force. For example, the biasing element 62 may include a rubber or resilient material disposed on at least one of the faces of the two pieces 64 and 66, such that the material provides a biasing force when the two pieces 64 and 66 are compressed together.

Figure 7:
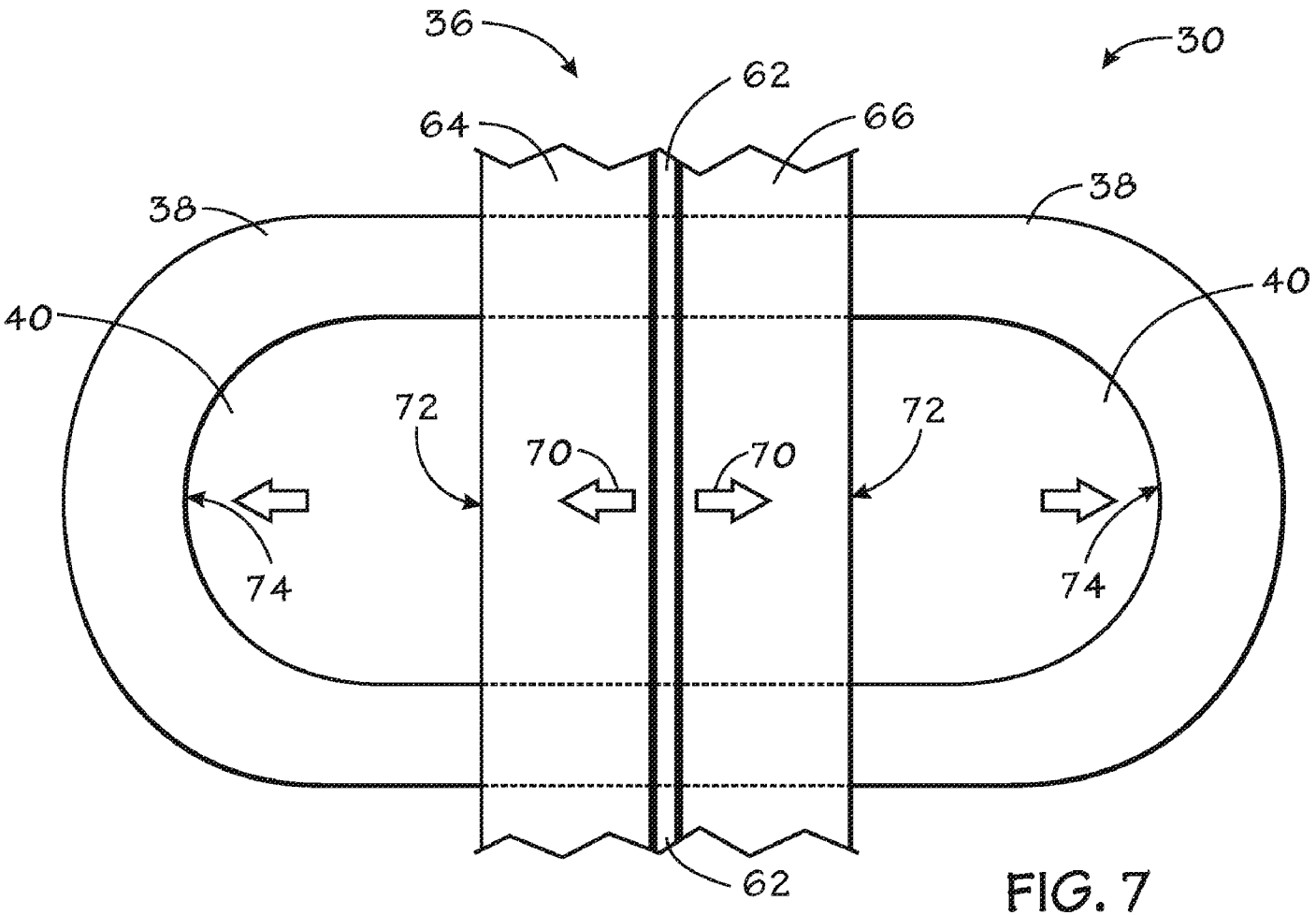
FIG. 7 is an illustration of a top view of a portion of the reactor of FIG. 2, including one conductive coil.

Turning now to FIG. 7, the top view of a portion of the inductor 30, including the magnetic core 36, biasing elements 62, a single conductive coil 39, and cooling elements 40 is depicted. The biasing elements 62 are disposed between the first piece 64 and the second piece 66 of the magnetic core 36. Accordingly, the biasing element 62 may provide a biasing force in the direction of the arrows 70. The force may urge the first piece 64 and the second piece 66 in the direction of the arrows 70 to increase contact between the magnetic core 36 and the cooling elements 40 at a core/cooling interface 72. Accordingly, the thermal resistance between the core/cooling interface 72 may be reduced, thereby, promoting the efficient transfer of thermal energy from the magnetic core 36 to the cooling elements 40.

Further, the biasing force provided by the biasing element 62 may urge the cooling elements 40 and the conductive coil 38 into contact. For example, the force in the direction of arrows 70 may be transmitted from the core 36 to cooling elements 40, and, thus, the cooling elements 40 may be displaced in the direction of arrow 70. The force and displacement on the cooling elements 40 may act to create or increase the contact between the surface of the cooling elements 40 and the surface of the conductive coil 38 at a coil/cooling interface 74. Accordingly, the thermal resistance between the coil/cooling interface 74 may be reduced, thereby promoting the efficient transfer of thermal energy from the conductive coil 38 to the cooling elements 40.

In one embodiment, the inductor 30 may include the support 56 (See FIG. 4) configured to allow increased movement of the cooling element 40. For example, if the support 56 remains in the inductor 30, the holes 60 may be increased in diameter relative to the fasteners 58, or may include a slot, such that the cooling element 40 is capable of displacing as the other components contract and expand. Further, such an embodiment may account for variations in the coefficient of thermal expansion for the support 56 relative to other components of the inductor 30.

While only certain features of the invention have been illustrated and described herein, many modifications and changes will occur to those skilled in the art. For example, the described system may be employed for heating elements, and or may be employed in similar systems that desire urging components into contact. It is, therefore, to be understood that the appended claims are intended to cover all such modifications and changes as fall within the true spirit of the invention.

The invention claimed is:

1. An electrical apparatus comprising:

a core;

a conductive coil wound around at least a part of the core;

a cooling element configured to receive a cooling fluid to cool the core and the coil during operation; and at least one biasing element operatively associated with the core to urge thermal engagement of the core, the coil, and the cooling element.

2. The apparatus of claim 1, wherein the cooling element comprises a portion disposed between the core and the coil.

3. The apparatus of claim 1, wherein the core includes at least two core pieces, and wherein the at least one biasing element is disposed between the core pieces to urge the core pieces away from one another.

4. The apparatus of claim 3, wherein the core includes two generally identical core pieces and two separate biasing elements are disposed between the core pieces at generally symmetrical locations.

5. The apparatus of claim 1, comprising a pair of cooling elements each disposed between an opposite side of the core and an opposite an end turn of the coil.

6. The apparatus of claim 1, comprising a rigid support disposed between the cooling elements and configured to position the cooling elements relative to one another.

7. The apparatus of claim 1, wherein the biasing element comprises a corrugated sheet of material or a beveled washer.

8. The apparatus of claim 1, wherein the biasing element comprises a resilient material.

9. An electrical apparatus comprising:

a core including two core pieces in mutually facing relation;

a conductive coil wound around a part of the core;

at least one cooling element disposed between a side of the core and an end turn of the coil and configured to receive a cooling fluid to cool the core and the coil during operation; and at least one biasing element disposed between the core pieces to urge thermal engagement between the core, the coil, and the cooling element despite differential expansion or contraction of the core and the coil and manufacturing tolerances.

10. The apparatus of claim 9, wherein the core comprises a material with a coefficient of thermal expansion that is not the same as the coefficient of thermal expansion of the conductive coil.

11. The apparatus of claim 9, wherein engagement of the core and the cooling element is configured to promote the transfer of thermal energy between the cooling element and the magnetic core.

12. The apparatus of claim 9, wherein engagement of the core and the conductive coil is configured to promote the transfer of thermal energy between the cooling element and the conductive coil.

13. The apparatus of claim 9, wherein the biasing element comprises a corrugated sheet of material or a beveled washer.

14. The apparatus of claim 9, wherein the biasing element comprises a resilient material.

15. An electrical apparatus comprising:

a core including two generally similar core pieces in mutually facing relation;

a plurality of conductive coils each wound around a respective part of the core;

a plurality of cooling elements disposed between a side of the core and an end turn of a respective coil and configured to receive a cooling fluid to cool the core and the coils during operation; and at least one biasing element disposed between the core pieces to urge thermal engagement between the core, the coils, and the cooling elements.

16. The apparatus of claim 15, comprising three coils each configured to be coupled to one phase of three-phase power.

17. The apparatus of claim 15, wherein each coil is associated with two cooling elements each disposed between opposite sides of the core and a respective end turn of the respective coil.

18. The apparatus of claim 15, wherein the each of the two pieces of the core comprise two halves, wherein each half is configured to be inserted through the center of one of the plurality of conductive coils and mate with the other half to form the core.

19. The apparatus of claim 15, wherein the biasing element comprises a corrugated sheet of material or a beveled washer.

20. The apparatus of claim 15, wherein the core comprises a magnetic core material.

* * * * *